US008721209B2

(12) United States Patent
Lin

(10) Patent No.: US 8,721,209 B2
(45) Date of Patent: May 13, 2014

(54) MULTI-FUNCTION PRINTER

(75) Inventor: Ching-Feng Lin, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 180 days.

(21) Appl. No.: 13/267,892

(22) Filed: Oct. 7, 2011

(65) Prior Publication Data

US 2013/0038190 A1 Feb. 14, 2013

(30) Foreign Application Priority Data

Aug. 10, 2011 (TW) ..... 100128554 A

(51) Int. Cl.
*B41J 29/02* (2006.01)

(52) U.S. Cl.
USPC ..... 400/693; 399/107; 220/260; 312/319.2; 312/326

(58) Field of Classification Search
USPC ..... 400/693
See application file for complete search history.

(56) References Cited

U.S. PATENT DOCUMENTS

| | | | | |
|---|---|---|---|---|
| 2,601,566 | A * | 6/1952 | Soderquist | 220/263 |
| 4,515,491 | A * | 5/1985 | Chevrel et al. | 400/693 |
| 5,121,521 | A * | 6/1992 | Hagiwara et al. | 16/278 |
| 6,163,431 | A * | 12/2000 | Fleckenstein et al. | 312/319.2 |
| 7,407,200 | B2 * | 8/2008 | Ichimaru | 292/194 |

* cited by examiner

*Primary Examiner* — Jill Culler
(74) *Attorney, Agent, or Firm* — Jianq Chyun IP Office

(57) ABSTRACT

A multi-function printer including a body, a door, a feeding module, a transmission module, and a cam assembly is provided. The door is assembled to the body being opened or closed relative to the body. The feeding module and the transmission module are disposed in the body. The feeding module has a driving gear. The transmission module has a swim arm with an end connected to the driving gear. The cam assembly is movably disposed in the body and configured between the door and the transmission module. The cam assembly is in a moving range of the swim arm, and the door is in a moving range of the cam assembly. When the driving gear rotates in a direction, the other end of the swim arm is engaged to the cam assembly, and drives the cam assembly to push the door open.

7 Claims, 4 Drawing Sheets

MULTI-FUNCTION PRINTER

CROSS-REFERENCE TO RELATED APPLICATION

This application claims the priority benefit of Taiwan application serial no. 100128554, filed on Aug. 10, 2011. The entirety of the above-mentioned patent application is hereby incorporated by reference herein and made a part of this specification.

BACKGROUND OF THE INVENTION

1. Field of the Invention

The invention relates to a printer, and more particularly to a multi-function printer having a door opening structure.

2. Description of Related Art

As the information society arrives, office automatic equipment such as scanners, photocopiers, or printers are disposed in offices, and users may perform secretarial processing operations using these office equipment. It should be noted that when the above plurality of office automatic equipment is simultaneously disposed in the office, a lot of space is consumed. As a result, a multi-function printer (MFP) integrated with functions such as copying, printing, and scanning is developed to resolve the above problem.

Furthermore, information is gradually entering a cloud computing stage, improving the processing speed and convenience when using information. Cloud computing uses the high computing and large storage capacity of a server group through the internet. This way, cloud computing replaces the original software installed on personal computers, or replaces the action of saving information on a personal hard disk. Instead, multiple actions are performed through the internet, and information is stored on the internet, a large virtual space. In other words, users can use cloud computing to perform multi-function printer operations without the restrictions of time and location.

SUMMARY OF THE INVENTION

The invention provides a multi-function printer with an automatic door opening structure.

An embodiment of the invention provides a multi-function printer including a body, a door, a feeding module, a transmission module, and a cam assembly. The door is assembled to the body and is opened or closed relative to the body. The feeding module and the transmission module are disposed in the body. The feeding module has a driving gear. The transmission module has a first swim arm, and an end of the first swim arm is connected to the driving gear. The cam assembly is movably disposed in the body, and is configured between the door and the transmission module. The cam assembly is in a moving range of the first swim arm, and the door is in a moving range of the cam assembly. When the driving gear rotates in a first direction, the other end of the first swim arm is engaged to the cam assembly, and drives the cam assembly to push the door open.

In an embodiment of the invention, when the driving gear rotates in a second direction, the other end of the first swim arm is disengaged from the cam assembly. The first direction is opposite to the second direction.

In an embodiment of the invention, the first swim arm is pivoted to the body, and the transmission module further includes a first gear and a second gear. The first gear is disposed on an end of the first swim arm, and is connected to the driving gear. The second gear is disposed on the other end of the first swim arm, and oscillates with the first swim arm. The cam assembly is located on a moving path of the second gear.

In an embodiment of the invention, the cam assembly includes a third gear and a cam coaxially disposed. The third gear is located on a moving path of the second gear. The first swim arm oscillates so the second gear is engaged or disengaged with the third gear.

In an embodiment of the invention, when the second gear is disengaged from the third gear, a protruding portion of the cam will move away from a door closing position of the body due to weight.

In an embodiment of the invention, the cam assembly includes a fourth gear, a second swim arm, and a cam. The fourth gear is located on a moving path of the second gear. The second swim arm moves so the second gear is engaged or disengaged with the fourth gear. The second swim arm is pivoted to the body. The cam and the fourth gear are respectively disposed on the two opposite ends of the second swim arm, and a protruding portion of the cam faces the door.

In an embodiment of the invention, the door is pivoted to the body. When the second gear is engaged to the fourth gear, an oscillating direction of the second swim arm is the same as the rotating direction of the door, and an oscillating direction of the first swim arm is opposite to the oscillating direction of the second swim arm.

Based on the above, in the embodiment of the invention, through the transmission module and the cam assembly disposed between the feeding module and the door, and through the feeding module causing the transmission module and the cam assembly to be engaged or disengaged, the cam assembly can perform the action of pushing the door open. In this way, the user does not need to manually control the multi-function printer, but uses the feeding module actuating the body to make sure the door is open. This allows the multi-function printer to satisfy the functional requirements of cloud equipment.

In order to make the aforementioned and other features and advantages of the invention more comprehensible, embodiments accompanying figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
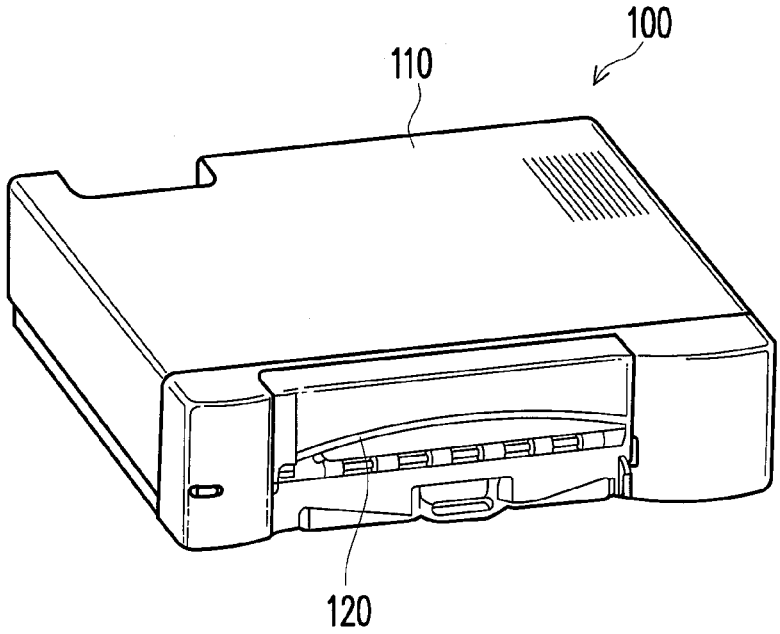
FIG. 1 and FIG. 2 are schematic views respectively illustrating a multi-function printer in different conditions according to an embodiment of the invention.
Figure 2:
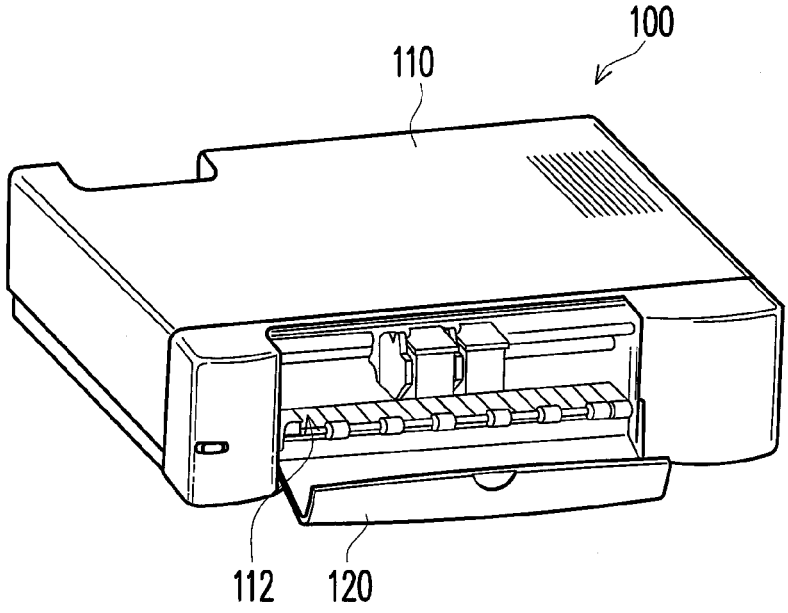
Figure 3:
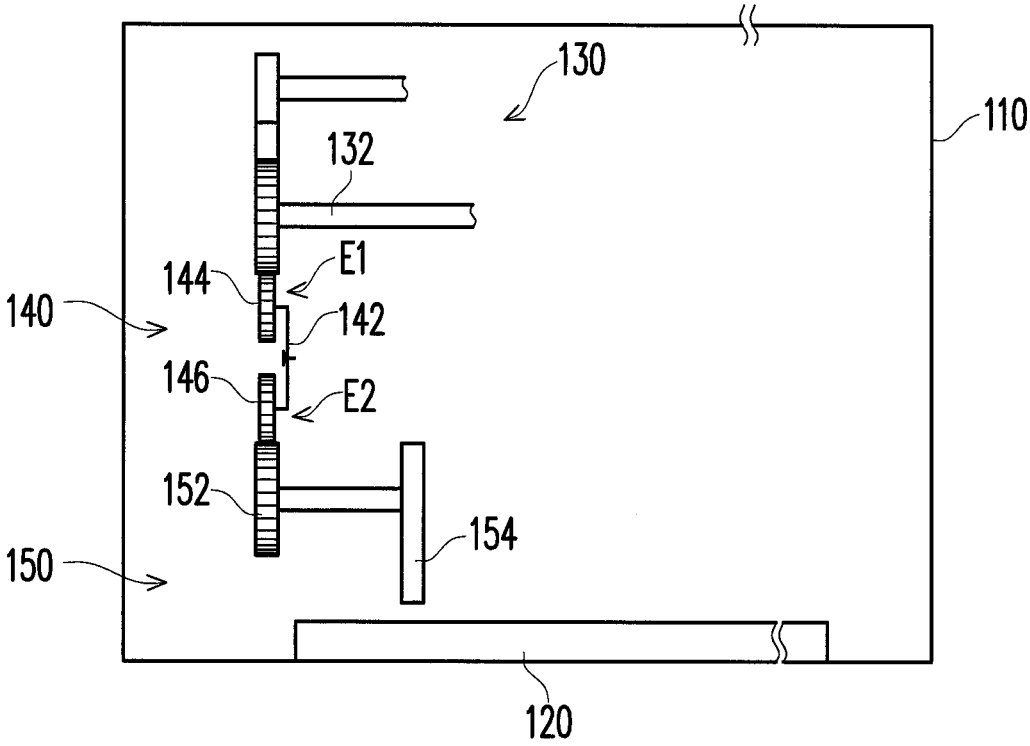
FIG. 3 is a partial top view of FIG. 1.

FIG. 1 and FIG. 2 are schematic views respectively illustrating a multi-function printer in different conditions according to an embodiment of the invention. FIG. 3 is a partial top view of FIG. 1. Referring to FIG. 1 to FIG. 3, in the embodiment, the multi-function printer 100 includes a body 110, a door 120, a feeding module 130, a transmission module 140, and a cam assembly 150.

The body 110 includes a paper outlet 112, and the door 120 is pivoted to the body 110 to open or close the paper outlet 112. The feeding module 130 is disposed in the body 110, and is used so paper that has finished printing or scanning (not shown) passes the body 110 through the paper outlet 112, and is transmitted out of the multi-function printer 100. In order to prevent the paper from being restricted by the door 120 when being transmitted out the body 110, the multi-function printer 100 must make sure the door 120 is in an open state before printing (or scanning). Thus, the mutual arrangement between the transmission module 140 and the cam assembly 150 disposed in the body 110 is required to complete the opening of the door 120.

Figure 4:
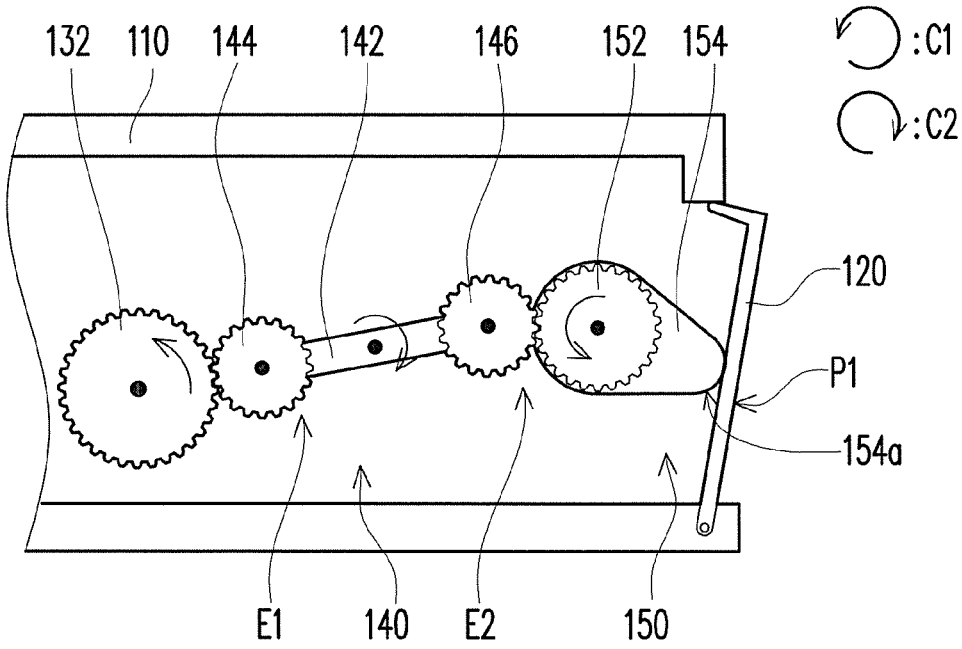
FIG. 4 and FIG. 5 are partial cross-sectional views respectively showing the multi-function printer of FIG. 3.
Figure 5:
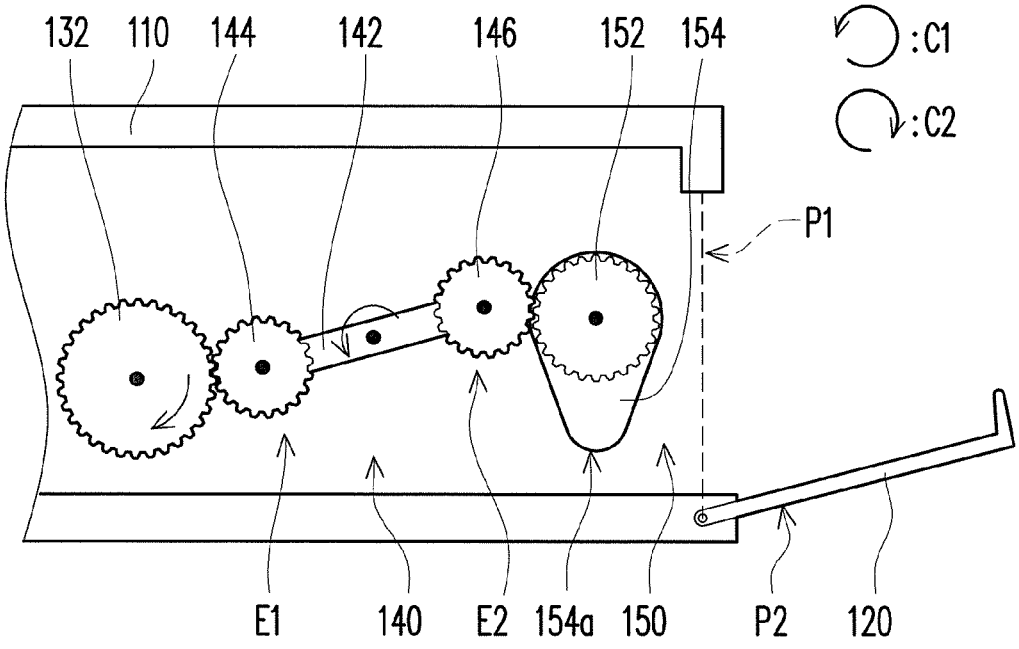

FIG. 4 and FIG. 5 are partial cross-sectional views respectively showing the multi-function printer of FIG. 3, to respectively describe the state of the door 120 of the multi-function printer 100 during opening and after opening. Please refer to FIG. 3 to FIG. 5. In detail, the transmission module 140 includes a first swim arm 142 and a first gear 144, a second gear 146 respectively disposed on a first end E1 and a second end E2 of the first swim arm 142. The first gear 144 disposed on the first end E1 is connected to a driving gear 132 of the feeding module 130. This way, when the driving gear 132 rotates it drives the first gear 144 to rotate, allowing the first swim arm 142 to create an oscillating effect. The second gear 146 disposed on the second end E2 of the first swim arm 142 oscillates in the same way.

Furthermore, the cam assembly 150 is rotatably disposed in the body 110. In the embodiment, the cam assembly 150 includes a third gear 152 and a cam 154 coaxially disposed. The third gear 152 is in an oscillating range of the second gear 146. Thus, when the driving gear 132 rotates, the first swim arm 142 is driven to oscillate, causing the second gear 146 on the second end E2 of the first swim arm 142 to be respectively engaged (shown in FIG. 4) and disengaged (shown in FIG. 5) with the third gear 152 of the cam assembly 150.

When the second gear 146 and the third gear 152 are engaged, the second gear 146 drives the third gear 152 to rotate because of the oscillation of the first swim arm 142. This causes the coaxially disposed cam 154 to be driven and rotated, so a protruding portion 154*a* of the cam 154 can push the door 120 from a closed position P1 to an open position P2. In the embodiment, the door 120 is latched to the body 110 with a latch structure (not shown). The goal of the cam 154 is to drive the door 120 to be disengaged from the latch structure, so it can then open with its own weight. Nonetheless, the invention is not limited thereto. In contrast, when the second gear 146 and the third gear 152 are in a disengaged state, the cam assembly 150 is not affected by the transmission module 140. When the cam 154 is in a state of receiving no force, the protruding portion 154*a* will move away from the closing position P1 of the door 120 due to its weight.

Referring to FIG. 4 and FIG. 5, for example, when the driving gear 132 rotates in a counterclockwise direction C1, the first gear 144 will be driven. This causes the first swim arm 142 to oscillate in a clockwise direction C2, driving the second gear 146 and the third gear 152 to be engaged. Next, the second gear 146 drives the third gear 152 to rotate in a counterclockwise direction C1. Therefore, the cam 154 rotates with the coaxial third gear 152, causing the protruding portion 154*a* to push the door 120 away from the closing position P1.

In contrast, when the driving gear 132 rotates in a clockwise direction C2, the first gear 144 is driven so the first swing arm 142 oscillates in a counterclockwise direction C1, disengaging the second gear 146 from the third gear 152. At this point the cam assembly 150 does not receive any force, and so the protruding portion 154*a* of the cam 154 will move away from the closing position P1 of the body 110 relative to the door 120 due to its weight.

It should be noted that in order for the door 120 to be in the opening position P2 before feeding the paper, and to prevent the feeding module 130 and the door 120 from interfering, the respective rotating directions of the driving gear 132 need to be opposite to respectively perform the aforementioned actions. In other words, when the driving gear 132 rotates in a counterclockwise direction C1, it will drive the transmission module 140 and the cam assembly 150 to open the door 120, and when the driving gear 132 rotates in a clockwise direction C2, only a paper feeding action is performed. The rotating directions of the driving gear 132, the transmission module 140, and the cam assembly 150 are not limited. That is to say, under the premise of the driving gear 132 rotating in two opposite directions to respectively open the door 120 and feed paper, a designer can make suitable changes to the relationship between the transmission module 140, the cam assembly 150, and the driving gear 132.

Figure 6:
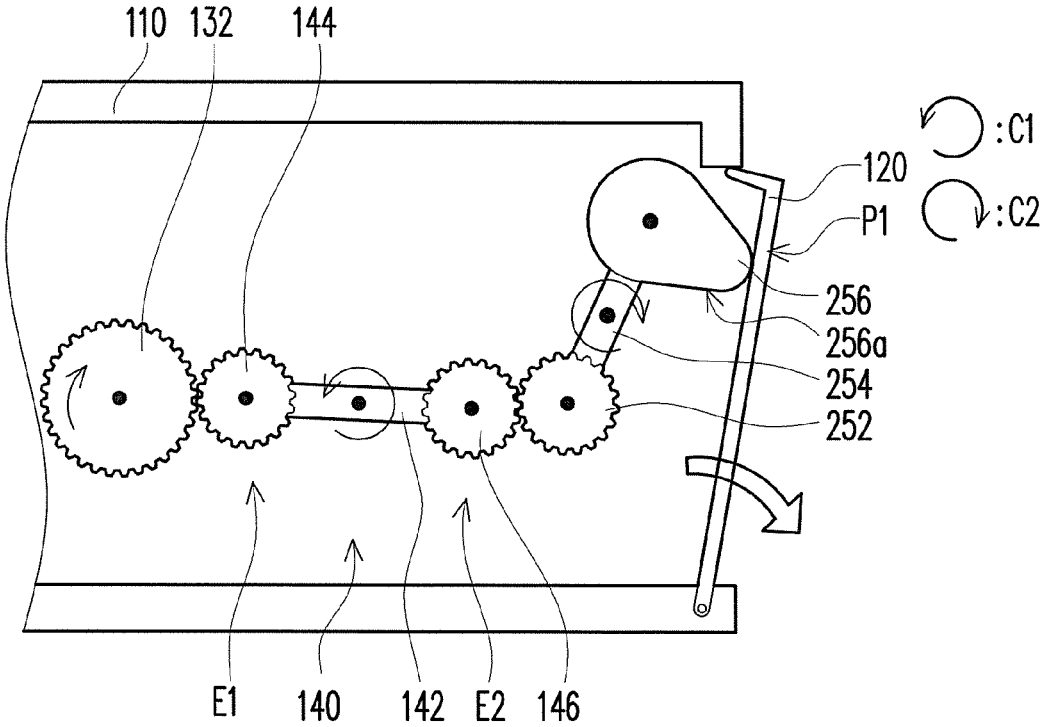
FIG. 6 and FIG. 7 are partial cross-sectional views respectively showing a multi-function printer according to another embodiment of the invention.
Figure 7:
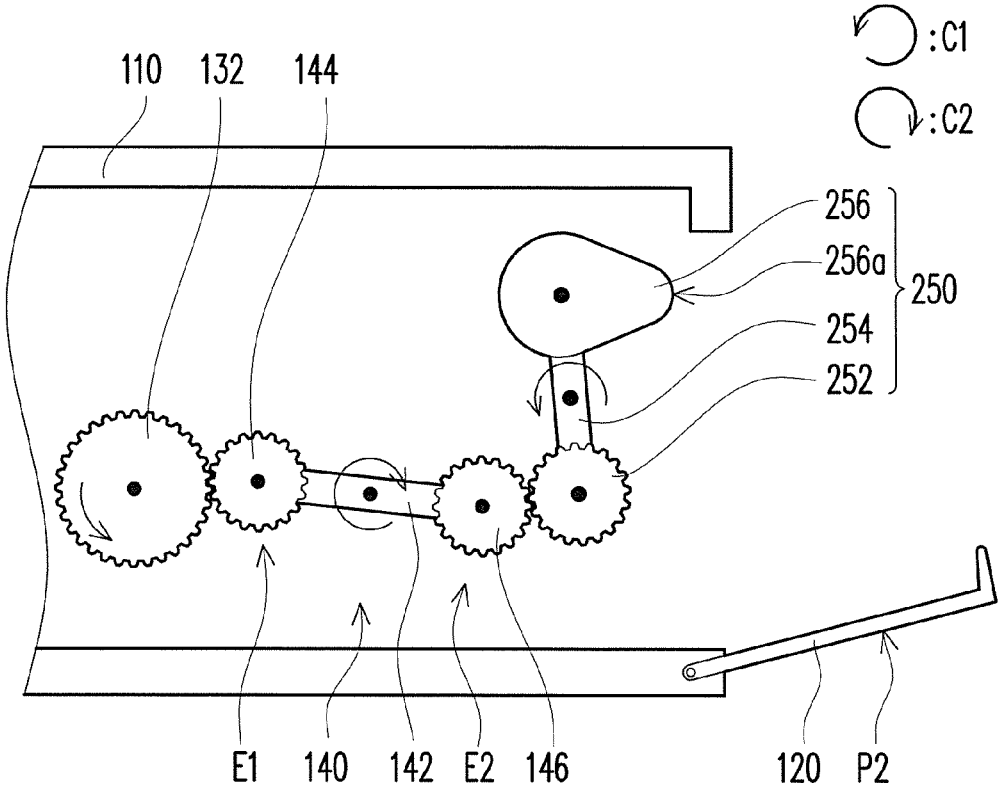

FIG. 6 and FIG. 7 are partial cross-sectional views respectively showing a multi-function printer according to another embodiment of the invention, and respectively show the state of the door during opening and after opening. Referring to FIG. 6 and FIG. 7, in a multi-function printer 200, the driving gear 132 and the transmission module 140 are both similar to the previous embodiment. The difference is a cam assembly 250 includes a fourth gear 252, a second swim arm 254, and a cam 256. The fourth gear 252 is similar to the third gear 152 of the previous embodiment, and is located on the moving path of the second gear 146. This way the first swim arm 142 oscillates causing the second gear 146 and the fourth 252 to be engaged or disengaged. In the embodiment, the second swim arm 254 is pivoted to the body 110. The cam 256 and the gear 252 are respectively located on the two opposite ends of the second swim arm 254, wherein a protruding portion 256*a* of the cam 256 faces the door 120.

Accordingly, when the driving gear 132 rotates in a clockwise direction C2, the first swim arm 142 oscillates in a counterclockwise direction C1. The second gear 146 and the fourth gear 252 are engaged, driving the second swim arm to oscillate in a clockwise direction C2. This drives the cam 256 to push the door 120 away from the closing position P1 and rotate towards the opening position P2.

In contrast, when the driving gear 132 rotates in a counterclockwise direction C1, the first swim arm 142 oscillates in a clockwise direction C2, driving the second swim arm 254 to rotate in a counterclockwise direction C1 through the second gear 146 and the fourth gear 252. This allows the cam assembly 250 to return to its original position, so that a better appearance is maintained when the door 120 is open.

To sum up, in the embodiment of the invention, through the transmission module and the cam assembly disposed between the feeding module and the door, and through the feeding module causing the transmission module and the cam assembly to be engaged or disengaged, the cam assembly can perform the action of pushing the door open. This way the user does not need to manually control the multi-function printer, but uses the feeding module actuating the body to make sure the door is open. This allows the multi-function printer to satisfy the functional requirements of cloud equipment.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A multi-function printer, comprising:

a body;

a door, assembled to the body and being opened or closed relative to the body;

a feeding module, disposed in the body, and the feeding module including a driving gear;

a transmission module, disposed in the body, and the transmission module including a first swim arm, an end of the first swim arm being connected to the driving gear; and a cam assembly, movably disposed in the body, and being configured between the transmission module and the door, wherein the cam assembly is in a moving range of the first swim arm, and the door is in a moving range of the cam assembly, when the driving gear rotates in a first direction, the other end of the first swim arm is engaged to the cam assembly, and drives the cam assembly to push the door open.

2. The multi-function printer as claimed in claim 1, wherein when the driving gear rotates in a second direction, the other end of the first swim arm is disengaged from the cam assembly, the first direction is opposite to the second direction.

3. The multi-function printer as claimed in claim 2, wherein the first swim arm is pivoted to the body, and the transmission module comprises:

a first gear, disposed on an end of the first swim arm, and connected to the driving gear; and a second gear, disposed on the other end of the first swim arm, and oscillates with the first swim arm, wherein the cam assembly is located on a moving path of the second gear.

4. The multi-function printer as claimed in claim 3, where in the cam assembly comprises:

a third gear, located on the moving path of the second gear, wherein the first swim arm oscillates so the second gear is engaged or disengaged with the third gear; and a cam, coaxially connected to the third gear.

5. The multi-function printer as claimed in claim 4, wherein when the second gear is disengaged to the third gear, a protruding portion of the cam moves away from the door closing position of the body due to its own weight.

6. The multi-function printer as claimed in claim 3, wherein the cam assembly comprises:

a fourth gear, located on the moving path of the second gear, wherein the first swim arm oscillates so the second gear is engaged or disengaged with the fourth gear;

a second swim arm, pivoted to the body; and a cam, wherein the cam and the fourth gear are respectively disposed on two opposite ends of the second swim arm, and a protruding portion of the cam faces the door.

7. The multi-function printer as claimed in claim 6, wherein the door is pivoted to the body, and when the second gear is engaged to the fourth gear, an oscillating direction of the second swim arm is the same as a rotating direction of the door, and an oscillating direction of the first swim arm is opposite to the oscillating direction of the second swim arm.

* * * * *